US011187019B2

(12) United States Patent
Sellar et al.

(10) Patent No.: US 11,187,019 B2
(45) Date of Patent: Nov. 30, 2021

(54) DOOR STOP

(71) Applicant: HGT Innovations Pty Ltd, Southbank (AU)

(72) Inventors: Mark Andrew Sellar, Southbank (AU); Kylie Jane Lush, Southbank (AU); Clayton Steve Lush, Southbank (AU)

(73) Assignee: HGT Innovations Pty Ltd, Southbank (AU)

( * ) Notice: Subject to any disclaimer, the term of this patent is extended or adjusted under 35 U.S.C. 154(b) by 630 days.

(21) Appl. No.: 16/068,522

(22) PCT Filed: Jan. 5, 2017

(86) PCT No.: PCT/AU2017/050007
§ 371 (c)(1),
(2) Date: Jul. 6, 2018

(87) PCT Pub. No.: WO2017/117628
PCT Pub. Date: Jul. 13, 2017

(65) Prior Publication Data

US 2019/0010742 A1 Jan. 10, 2019

(30) Foreign Application Priority Data

Jan. 7, 2016 (AU) ..... 2016900046
Apr. 6, 2016 (AU) ..... 2016901278

(51) Int. Cl.
*E05C 17/56* (2006.01)

(52) U.S. Cl.
CPC ..... *E05C 17/56* (2013.01)

(58) Field of Classification Search
CPC ..... E05C 17/56; Y10S 292/18; E05B 47/004
USPC ..... 292/251.5
See application file for complete search history.

(56) References Cited

U.S. PATENT DOCUMENTS 2,497,697 A * 2/1950 Smith ..... E05C 17/56 292/74
3,258,285 A * 6/1966 Smith ..... E05C 17/56 292/251.5
3,791,687 A 2/1974 Schroeder
4,702,038 A 10/1987 Frey
(Continued)

FOREIGN PATENT DOCUMENTS

CH 383822 A 10/1964
CN 201276912 Y 7/2009
(Continued)

OTHER PUBLICATIONS

Jul. 13, 2020 Office Action issued in connection with corresponding Chinese application No. 201780005834.3.
(Continued)

*Primary Examiner* — Kristina R Fulton
*Assistant Examiner* — Steven A Tullia
(74) *Attorney, Agent, or Firm* — Potomac Law Group, PLLC; Kenneth Fagin

(57) ABSTRACT

A method of installing a door-carriable portion (2), for a door stop (1), to be carried by a door. The door-carriable portion includes a magnet and a retaining member (7). The method includes drilling a hole in a bottom of the door; placing the magnet in the hole; and fastening the retaining member to the bottom of the door to at least partly span the opening to retain the magnet.

12 Claims, 4 Drawing Sheets

(56) References Cited

U.S. PATENT DOCUMENTS

| | | | | | |
|---|---|---|---|---|---|
| 4,995,655 | A * | 2/1991 | Freeman | E05C 17/56 | 292/251.5 |
| 5,944,368 | A * | 8/1999 | Hastings | E05C 17/56 | 292/251.5 |
| 6,321,411 | B1 * | 11/2001 | Ikejiri | E05C 17/56 | 16/82 |
| 7,367,596 | B2 * | 5/2008 | Leung | E05B 65/0021 | 292/148 |
| 7,905,525 | B2 * | 3/2011 | Badia | E05B 17/007 | 292/262 |
| 8,491,020 | B2 * | 7/2013 | Lopes | E05C 3/042 | 292/194 |
| 8,864,188 | B2 | 10/2014 | Redgrave | | |
| 2011/0049911 | A1 | 3/2011 | Bosshard | | |
| 2011/0101711 | A1 | 5/2011 | Della-Santa | | |

FOREIGN PATENT DOCUMENTS

| | | | | | |
|---|---|---|---|---|---|
| CN | 201367788 | Y | 12/2009 | | |
| CN | 201614820 | U | 10/2010 | | |
| CN | 103015821 | A | 4/2013 | | |
| CN | 108590397 | A * | 9/2018 | E05C 17/56 | |
| DE | 2326386 | A1 * | 1/1974 | E05C 17/56 | |
| DE | 10336433 | A1 * | 3/2005 | E05C 17/56 | |
| DE | 202006016677 | U1 * | 12/2007 | E05C 17/56 | |
| DE | 102007037775 | A1 * | 2/2009 | E05C 17/446 | |
| DE | 202009011772 | U1 * | 12/2009 | E05C 17/48 | |
| DE | 102009035824 | A1 | 2/2011 | | |
| DE | 102009035824 | A1 * | 2/2011 | E05C 19/163 | |
| EP | 1820924 | A1 * | 8/2007 | E05C 19/163 | |
| EP | 1865134 | B1 | 6/2009 | | |
| EP | 2093358 | A1 * | 8/2009 | E05C 17/56 | |
| EP | 2154319 | A2 * | 2/2010 | E05C 17/446 | |
| EP | 2154320 | A2 | 2/2010 | | |
| GB | 1268362 | A * | 3/1972 | E05B 47/004 | |
| GB | 1480969 | | 7/1977 | | |
| GB | 1530591 | A | 11/1978 | | |
| GN | 1417441 | A | 5/2003 | | |
| JP | 3252142 | B2 | 1/2002 | | |
| KR | 20020035777 | A * | 5/2002 | | |
| KR | 2020120005647 | * | 8/2012 | E05C 17/48 | |
| WO | 2001036771 | A1 | 5/2001 | | |
| WO | WO-2009143636 | A1 * | 12/2009 | E05C 17/02 | |

OTHER PUBLICATIONS

International Search Report issued in the International Application No. PCT/AU2017/050007, dated Jul. 13, 2017.

Written Opinion issued in the International Patent Application PCT/AU2017/050007, dated Jul. 13, 2017.

Russian Examiner's Report dated May 29, 2020, issued in Russian Application No. 2018128581/12.

Russian Search Report dated May 29, 2020, issued in Russian Application No. 2018128581/12.

* cited by examiner

DOOR STOP

FIELD

This invention relates to a door stop.

BACKGROUND

A door stop is a device which serves to stop a moving door. Some door stops also serve to hold the door in position.

An existing door stop includes a wall-carriable portion and a door-carriable portion. The wall-carriable portion is mounted to project outwardly from the skirting board of a wall. The door-carriable portion is mounted towards the lower edge, and on one of the main upright faces, of the door. The portions magnetically co-operate to hold the door open up against the wall.

As the words are used herein a magnet is an item capable of magnetically attracting certain other materials, that attraction is referred to as magnetic co-operation, and each of the magnet and the certain other materials is said to be a magnetically co-operable material.

It is sometimes convenient to stop a door at a location at which there is no convenient point for mounting a wall-carriable portion of a door stop. Some door stops incorporate a floor-carriable portion mounted in or on the floor to co-operate with a door-carriable portion of the stop.

Various existing wall-carriable portions, floor-carriable portions, and door-carriable portions, present tripping hazards. These portions are often unsightly, whereas in many applications aesthetics are critical. The feeling experienced by a user moving a door into abutment with a stop is also important. On the one hand, the stop should not feel harsh or 'crashy'. On the other hand, it is desirable that the stop does not feel loose, sloppy or squishy. The feeling of a door is a nuanced characteristic of significant financial value in the context of premium applications. Likewise, unpleasant noise is to be avoided.

Some existing door stops incorporate a door-carriable portion seated within a shaped cavity formed (e.g. by routing) in the bottom edge of the door. This approach addresses the tripping hazard and unsightly aesthetics of the door-carriable portion.

Nonetheless, the present inventors have recognised that further improvement is possible.

In view of the foregoing discussion, at least preferred forms of the invention aim to provide an improved door stop and/or components and/or methods therefor.

It is not admitted that any of the information in this patent specification is common general knowledge, or that the person skilled in the art could be reasonably expected to ascertain or understand it, regard it as relevant or combine it in any way before the priority date.

SUMMARY

One aspect of the invention provides a method of installing a door-carriable portion, for a door stop, to be carried by a door;

the door-carriable portion including a magnet and a retaining member;

the method including drilling a hole in a bottom of the door;

placing the magnet in the hole; and fastening the retaining member to the bottom of the door to at least partly span the opening to retain the magnet.

The retaining member may be a striker plate including screw holes, in which case the fastening may include passing screws through the screw holes.

Another aspect of the invention provides a door-carriable portion, for a door stop, to be carried by a door and including a magnet receivable within a drilled cylindrical hole opening from a bottom of the door; and a striker plate having screw holes by which it is fastenable to the bottom of the door to at least partly span the opening to retain the magnet.

Preferably the door-carriable portion is magnetically co-operable with a floor-carriable portion to lift an engaging member, of the floor-carriable portion, as the door is moved in a direction;

the striker plate including an inclined portion for bearing against and downwardly driving the engaging member, as the door is moved in a direction, to bring the door to a soft stop; and a stop portion positioned relative to the inclined portion, to when the door is so moved follow the inclined portion, and shaped to be blocked by the engaging member to stop the door when the door is slammed.

Another aspect of the invention provides a door-carriable portion, for a door stop, to be carried by a door;

the door-carriable portion being magnetically co-operable with the floor-carriable portion to lift the engaging member as the door is moved in a direction;

the door-carriable portion including an inclined portion for bearing against and downwardly driving the engaging member, as the door is moved in a direction, to bring the door to a soft stop; and a stop portion positioned relative to the inclined portion, to when the door is so moved follow the inclined portion, and shaped to be blocked by the engaging member to stop the door when the door is slammed.

A member may define the inclined portion and the stop portion.

The inclined portion is preferably curved so as to vary a speed at which the engaging member is driven relative to a speed of the door. Most preferably the inclined portion is a rear of a recess for receiving an end of the engaging member, e.g. a rear of an at least approximately spherical recess for receiving an end of the engaging member.

Another aspect of the invention provides a pin, for a floor-carriable portion of a door stop, including a rigid body and a compliant top and being magnetically co-operable with a door-carriable portion of the door stop to be lifted to engage the top with the door-carriable portion.

Preferably the rigid body at least predominantly consists of magnetically co-operable material. The compliant top may be moulded over the rigid body.

Most preferably, the rigid body has an exterior dimensioned to slide within a parallel-piped formation; and the compliant top has an exterior set back from the exterior of the rigid body to clear the parallel-piped formation.

Also disclosed is a door stop incorporating one or more of the preceding components. The floor-carriable portion preferably includes a floor-contacting member having a body, for insertion into a hole in the floor, and a portion (e.g. an annular flange) projecting outwardly from an end of the body to sit atop the floor. Preferably the portion projecting outwardly from an end of the body has a top and an outer periphery, and the top slopes downwardly towards the outer periphery. The floor-contacting member may be dimensioned to project no more than 3 mm above the floor.

Also disclosed is a door stop including a floor-carriable portion, to be carried by a floor, including an engaging-member; and a door-carriable portion to be carried by a door so that at least most of the door-carriable portion is hidden by the door;

wherein the door-carriable portion is magnetically co-operable with the floor-carriable portion to lift the engaging member, from a position in which the engaging member is upright and at least most of the engaging member is within the floor, to engage the door-carriable portion whilst at least most of the floor-carriable portion underlies the door.

Also disclosed is a door stop including a floor-carriable portion, to be carried by a floor, including an engaging member; and a door-carriable portion to be carried by a door;

wherein the door-carriable portion is magnetically co-operable with the floor-carriable portion to lift the engaging member, from a position in which the engaging member is upright and at least most of the engaging member is within the floor, to engage the door-carriable portion;

the floor-carriable portion includes a floor-contacting member having a body, for insertion into a hole in the floor, and a portion projecting outwardly from an end of the body to sit atop the floor;

the portion projecting outwardly from an end of the body is an annular flange having a top and an outer periphery, and the top slopes downwardly towards the outer periphery.

Also disclosed is a door stop including a floor-carriable portion, to be carried by a floor, including an engaging member; and a door-carriable portion to be carried by a door, magnetically co-operable with the floor-carriable portion to lift the engaging member to engage the door-carriable portion, and including a magnet receivable within a cylindrical hole opening from a bottom of the door; and a retaining member fastenable to the bottom of the door to at least partly span the opening to retain the magnet.

Also disclosed is a floor-carriable portion, for a door stop, to be carried by a floor and including an engaging member magnetically co-operable with a door-carriable portion of the door stop to be lifted, from a position in which the engaging member is upright and at least most of the engaging member is within the floor, to engage the door-carriable portion; and a floor-contacting member having a body, for insertion into a hole in the floor, and a portion projecting outwardly from an end of the body to sit atop the floor;

wherein the portion projecting outwardly from an end of the body is an annular flange having a top and an outer periphery, the top slopes downwardly towards the outer periphery; and the floor-contacting member is a guide member within which the engaging member slides when so lifted.

Also disclosed is a method of installing a floor-carriable portion, for a door stop, to be carried by a floor;

the floor-carriable portion including an engaging member magnetically co-operable with a door-carriable portion of the door stop to be lifted, from a position in which the engaging member is upright and at least most of the engaging member is within the floor, to engage the door-carriable portion; and a floor-contacting member having a body, for insertion into a hole in the floor, and a portion projecting outwardly from an end of the body to sit atop the floor;

the method including drilling a cylindrical hole in the floor; and inserting the body into the hole so that the portion projecting outwardly from an end of the body to sits atop the floor to position the floor-contacting member.

DESCRIPTION OF EMBODIMENTS

Figure 1:
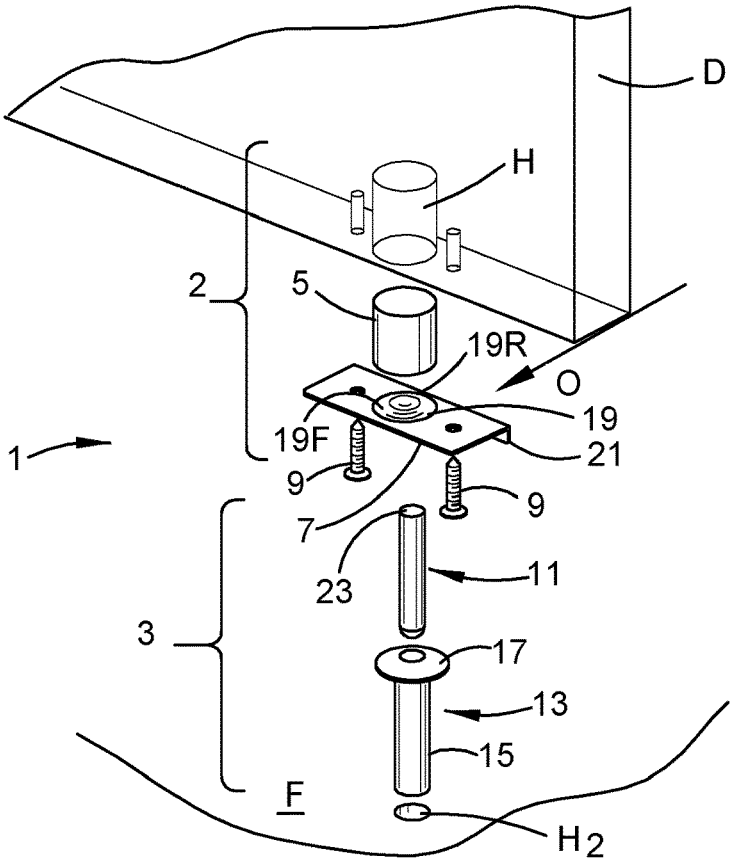
FIG. 1 is an exploded view of a door, a door stop and a floor.
Figure 2:
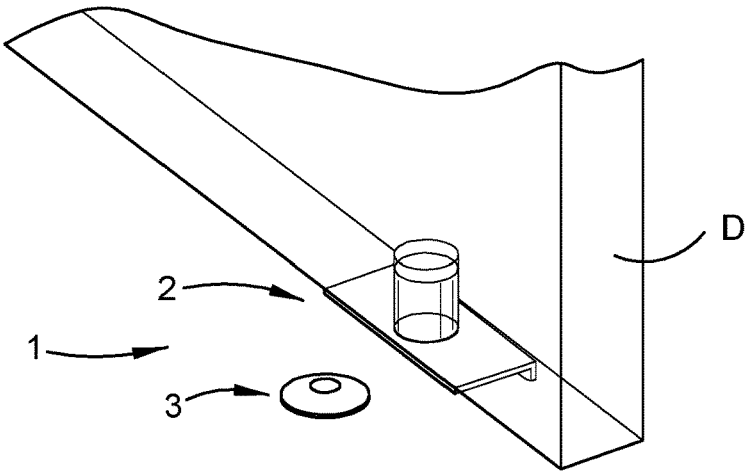
FIG. 2 is a perspective view of the door, door stop and floor of FIG. 1.

The following examples are intended to illustrate to enable reproduction and comparison. They are not intended to limit the scope of the disclosure in any way.

The door stop 1 includes a door-carriable portion 2 and a floor-carriable portion 3. The door-carriable portion 2 includes a magnet 5, a striker plate 7 and two screws 9. The floor-carriable portion 3 includes a pin 11 and a guide sleeve 13 in which the pin 11 axially slides.

The magnet 5 is preferably a neodymium rare earth magnet and preferably has a strength of at least N35. In this example, the magnet is a simple cylindrical body with a slightly longer than square aspect ratio.

To install the door-carriable portion 2 a simple cylindrical hole H is drilled in the bottom of the door D. The hole H opens downwardly from the bottom horizontal face of the door D. In this example, the hole H is a simple cylindrical hole formed using a suitable drill-bit such as a spade-bit, and has a diameter of 25 mm and a depth of about 30 mm. A simple cylindrical hole is sufficient. There is no need for routing, etc, to form a more complex shape.

The striker plate 7 is a pressed metal part dimensioned to fit over the outer open end of the hole H. In this case it is formed of low magnetic stainless steel. The screws 9 (which are 8 g×25 mm stainless steel screws in this case) pass through suitable screw holes in the striker plate to engage with the door D. The striker plate 7 is dimensioned to fully span the open free end of the hole H and therefore occlude the hole so as to retain the magnet 5. The door-carriable portion is thus installable quickly and easily with a single drilling operation and two screw driving operations. Optionally, the door may be pre-drilled to accept the screws. Once the door-carriable portion has been installed, the door can be hung (or re-hung). The door-carriable portion 2 is configured to suit doors that clear the floor by no more than 15 mm. If the clearance is higher, the plate 7 and in turn the magnet 5 can be downwardly reset with the aid of a suitable packer(s) between the plate 7 and the door D.

The pin 11 is formed of high magnetic steel, that is, it is not a magnet itself but is magnetically co-operable with the magnet 5 so that the magnet 5 and pin 11 are attracted to each other. Preferably, the pin 11 is nickel plated or is otherwise treated to resist corrosion. It is plausible that the pin 11 could be replaced by a non-magnetically co-operable member arranged to be lifted by another member, of the portion 3, that is magnetically co-operable with the magnet 5.

The sleeve 13 is preferably formed of non-magnetic material. In this case it is formed of acetyl. The sleeve includes an upwardly open tubular body the lower end of which is closed. In this case the pin 11 and the body 15 of the sleeve 13 are both cylindrical although other shapes are possible. An annular flange 17 encircles and projects outwardly from the top end of the body 15. The top surface of the flange 17 is spherically domed.

To install the floor-carriable portion 3 a hole $H_2$ is drilled into the floor F. The floor may be formed of any number of possible materials. Whilst the drill bit should of course be selected to suit the material, as in connection with the hole H, for most applications a simple drill bit of a type within the possession of most tradespersons can be used. There is no need for routing complex shapes. All that is required is a simple cylindrical hole. In this case the hole is drilled to a diameter of 14 mm.

To install the floor-carriable portion 3, the sleeve 13, or more specifically its body 15, is inserted into the hole $H_2$. Optionally, that insertion may be preceded by the application of a suitable adhesive; e.g., silicon may be applied to form a waterproof seal to keep water out of the hole $H_2$. The sleeve 13 can be simply inserted until its flange 17 abuts the top of the floor F. This abutment sets the height of the sleeve 13 relative to the floor and as such the hole $H_2$ can be drilled quickly and easily without any need to control its depth other than to ensure that it is at least as long as the body 15.

The domed flange 17 is dimensioned to project no more than about 2.5 mm above the top of the floor F. Additionally its domed surface outwardly tapers downwardly to a cylindrical rim that is only about 1 mm high. As such the floor-carriable portion 3 is not a trip hazard. Indeed, it is barely noticeable even if stepped on.

The door stop 1 may be conveniently installed by first installing one of the portions 2, 3 and then moving the door to ascertain and mark the appropriate location at which to install the other of the portions 2, 3. The door and portion 2 are set so that the portion 2 sits within several millimeters above the portion 3. The door stop 1 could in theory be placed at any convenient point along the bottom of the door D, although in the context of swinging doors, the door stop 1 is preferably positioned adjacent the free vertical end of the door spaced from the hinges. This reduces the applicable leverage ratio so that the door is more securely held and reduces the bending moment being passed through the door. Bending moments associated with door stops mounted close to hinges can damage the door and/or its hinges, particularly in the case of lightweight hollow-core doors.

The striker plate 7 has a long rectangular shape dimensioned to run along the bottom face of the door D. Centrally mounted along the shape is a domed feature which presents a downwardly open spherical recess 19.

When the door is moved in an opening direction (as suggested by the arrow O in FIG. 1) toward the floor-carriable portion 3, the pin 11 is upwardly drawn by the magnet 5 so that the end 23 of the pin 11 is received into the recess 19. In other variants of the invention, the pin 11 may itself be a magnet, in which case the magnet 5 may be replaced by a non-magnet formed of magnetically co-operable material.

Once the pin 11 has been upwardly drawn, the end 23 of the pin 11 bears against the interior of the recess 19. The pin thus constitutes an engaging member. Other forms of engaging member are possible. With continued movement of the door relative to the pin 11, the pin 11 is driven down a downwardly inclined rear face 19R of the recess 19. As such, work is done to move the pin 11 away from the magnet 5 towards which it is drawn. This downward driving has been found to produce a desirable soft stop so that when a door is opened in normal fashion the door is brought to a stop without crashing or feeling loose and sloppy, etc. The downward curvature of the rear 19R increases the rate at which the pin is downwardly driven relative to the speed of the door, as the door moves in its opening direction O. This contributes to the premium feel of the stop. Curvatures other than spherical are possible.

The co-operation of the pin 11 with the recess 19 is sufficient to stop the door when it is opened in normal fashion, although the inventors have recognised that when the door is slammed it is possible to overpower this mechanism. Accordingly, the striker plate further includes a stop portion in the form of a down-turned lip running along one of the long edges of the plate and positioned to follow the recess 19. The lip 21 defines a vertical planar face to positively engage the pin 11. Other forms of stop portion are possible.

The door stop 1 is configured to be unobtrusive. The plate 7 is dimensioned so that its entirety underlies the door D, that is, it does not include any portions which project outwardly beyond the door D. Additionally the magnet 5 and most of each of the screws 9 are concealed within the door D. As such the vast majority of the portion 2 is hidden by the door albeit that the lip 21 may be discernible.

The top end 23 of the pin 11 is mounted so that in its free condition it sits flush with the top of the flange 17 so that the flange 17 and end 23 together define a low profile head of the portion 3. As such the portion 3 is also unobtrusive in that it is for the most part concealed within the floor F. Additionally, when the door D is opened and the stop 1 is operative to hold the door D, the entirety of portion 3 underlies the door D. The head 17, 23 is of low enough profile that it does not interfere with floor cleaning operations such as vacuuming, sweeping, and mopping.

The forward portion 19F of the recess 19 is essentially the reverse of the rear 19R. When the door is moved opposite to the arrow O the portion 19F also serves to downwardly drive the pin 11 which creates the sensation of a 'soft opening'. Once the pin 11 disengages the plate 7, it simply drops into the sleeve 13 under its own weight.

Unless otherwise noted, the various members described herein are each integrally formed. As used herein 'integrally formed' and similar wording is used in its conventional sense to refer to formation from a single continuous body of material. As such, two bodies may be integrated by welding but not by other modes of connection, such as by typical adhesives, which result in separate mutually fastened bodies.

Figure 3:
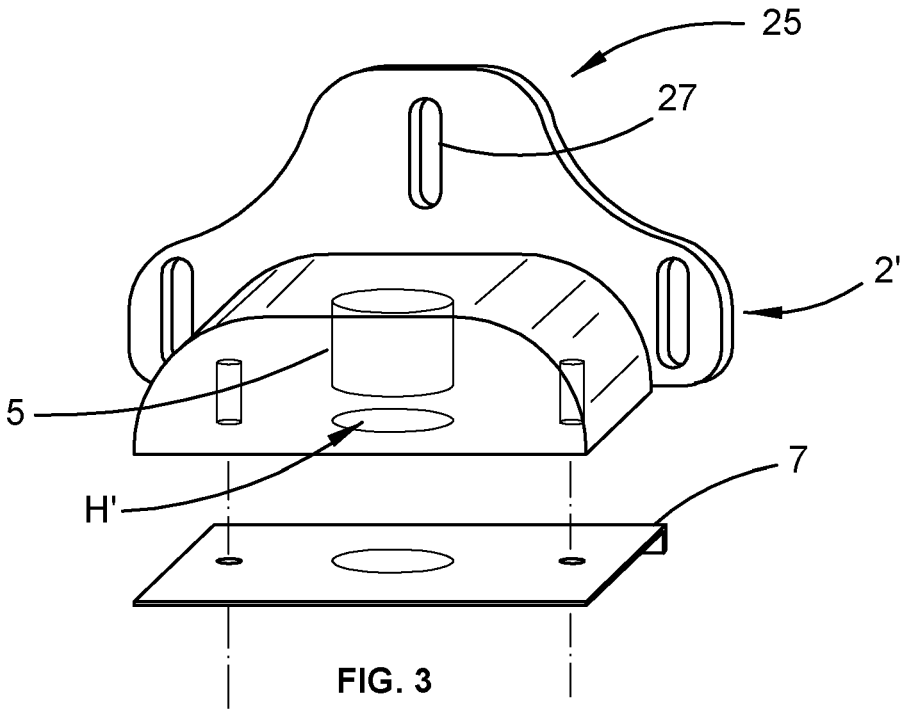
FIG. 3 is an exploded view of a door-carriable portion.
Figure 4:
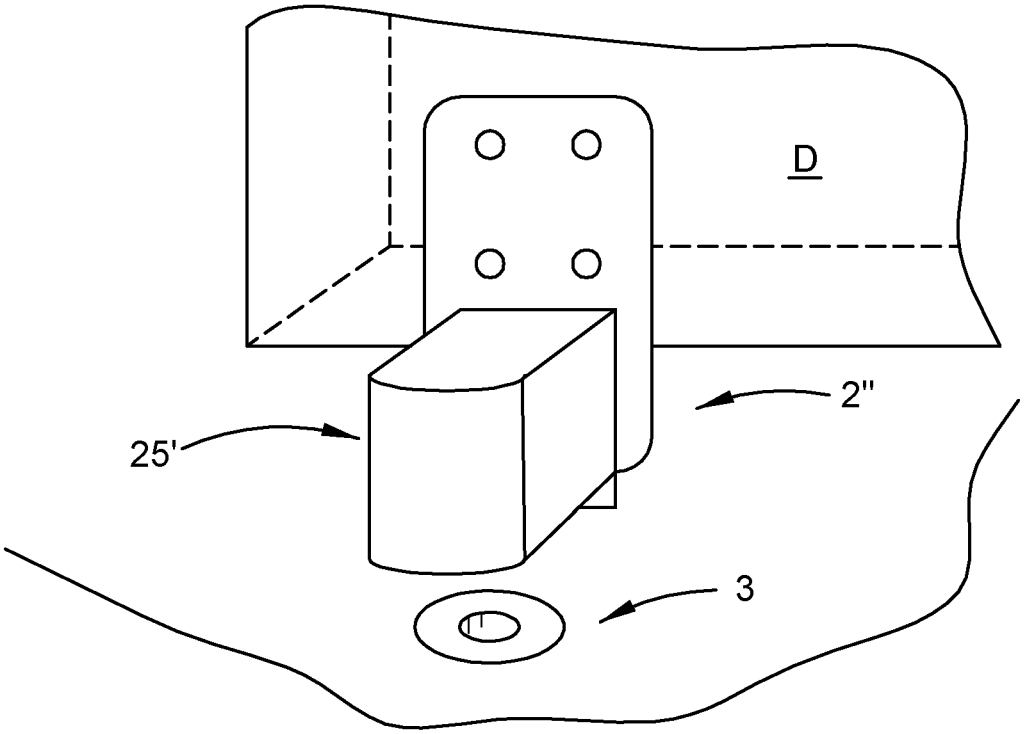
FIG. 4 is a perspective view of a door, a door stop and a floor.

FIGS. 3 and 4 illustrate door-carriable portions 2', 2" mountable on an upright main face of the door. For this purpose, the door-carriable portion 2' incorporates a body 25 incorporating a plate portion through which slotted mounting holes 27 pass and a magnet-receiving portion including a hole H' for receiving the magnet 5 and to which the plate 7 is fastenable. To mount the body 25 on the face of the door, the plate portion is positioned against the door and suitable fasteners are passed through the holes 27. The holes 27 are vertically slotted to allow for easy vertical adjustment.

The door-carriable portion 2' can be easily attached to the bottom of a door that has already been hung without the need to take the door off its hinges. On the other hand, the body 25 remains visible. It is contemplated that a kit of parts including the body 25 may be provided to give consumers the choice of easy installation or hidden installation for pre-hung doors.

The door-carriable portion 2" does away with the striker plate 7 by integrating its key features with the body 25', e.g. the body 25' could be formed by over-moulding synthetic material about a magnet (not shown).

Figure 5:
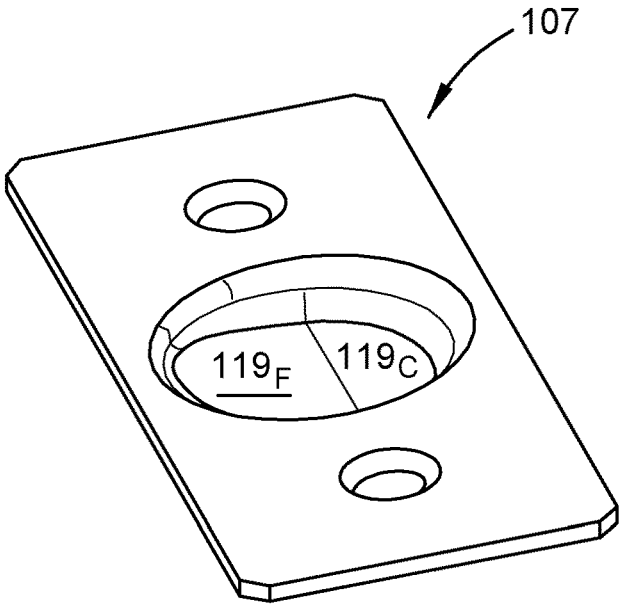
FIG. 5 is a perspective view of a striker plate.
Figure 6:
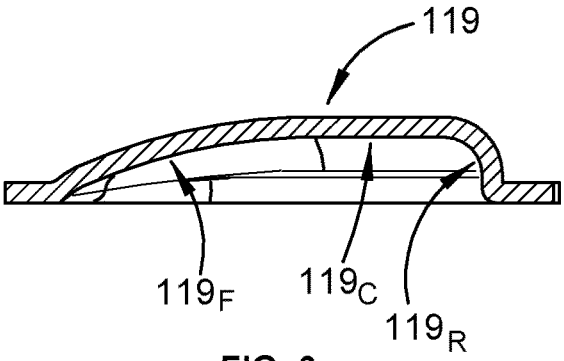
FIG. 6 is a cross-section view of the striker plate.

FIG. 5 illustrates an alternate striker plate 107 wherein the lip 21 has been placed by a re-contoured dimple 119. The dimple 119 includes a large radius forward section $\mathbf{119}_F$ along which the pin 23 slides as the door carrying the striker plate 107 moves in its opening direction. With continuing movement in this direction the pin 23 rides from the portion $\mathbf{119}_F$ on to the planar central portion $\mathbf{119}_F$. The dimple 119 includes an upright rear $\mathbf{119}_R$ forming a stop portion for positively engaging the pin 23 to stop the door if the door is slammed open.

This lip-free striker plate is particularly suited to doors having minimal clearance above the floor.

Figure 7:
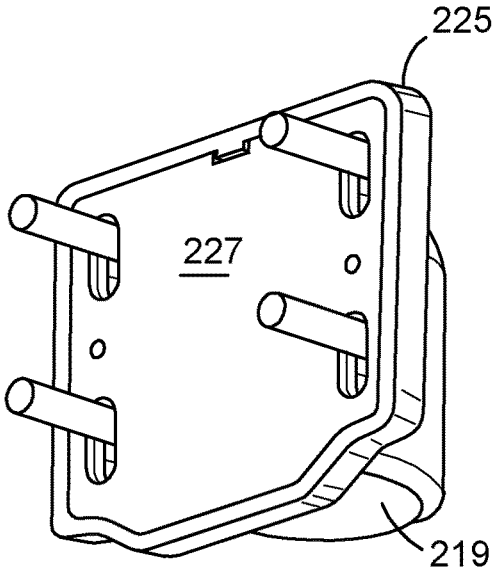
FIG. 7 is a rear perspective view of a door-carriable portion.
Figure 8:
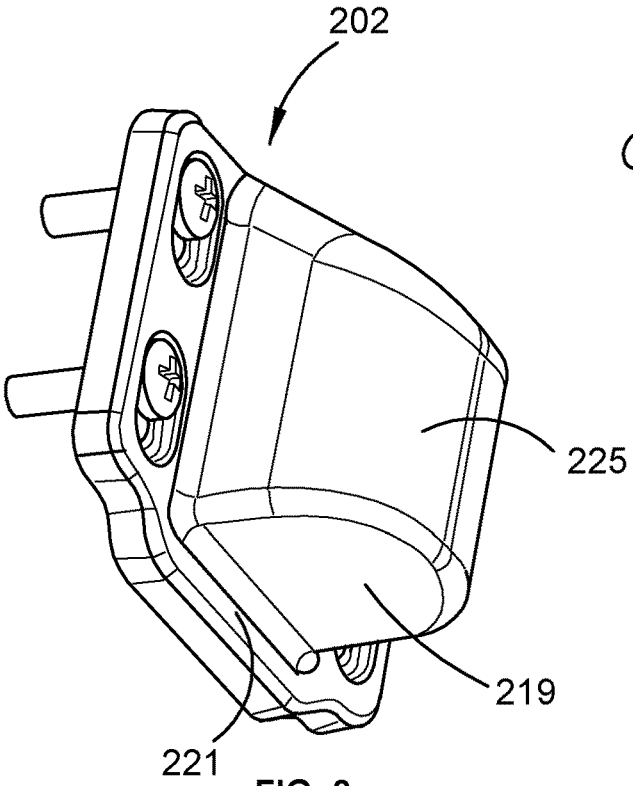
FIG. 8 is a front perspective view of the door-carriable portion.

FIGS. 7 and 8 illustrate an alternate face-mounted door-carriable portion 202 including a plastic housing 225 in which the magnet (not shown) is carried. The plastic housing is backed by a metallic support plate 227 which helps to distribute load. The housing 225 has a pair of slide flanges through which suitable screw holes open. The screw holes are slotted and counter bored to allow for some vertical adjustment and to accommodate the screw heads. The plate 227 has a complementary array of slotted screw holes.

Instead of a dimple, the portion 202 has a simple planar underside 219 against which the pin 23 may bear. Following this underside is a stop portion 221. When the door is moved in an opening direction the pin 23 is drawn up to ride along the flat surface 219, and if the friction therebetween is insufficient to stop the door the stop portion 221 moves in a contact with the pin. The carriable portion 202 includes nothing akin to the dimple front $\mathbf{19}_F$ to resist closing of the door. Rather it is intended to merely stop the door rather than to also act as a door holder. Typically this door stop would be used in conjunction with a door closing device that provides a closing force stronger than the resistance offered by the simple friction between the pin 23 and the surface 219.

Variants of the door-carriable portion 202 in which the housing 225 is formed of stainless steel (or other fire-resistant material) are particularly suited to stopping fire doors which should not be held open and are often mounted in locations such as emergency stairwells where the tripping hazards imposed by projecting floor-carriable portions may be particularly problematic.

Fire doors are configured to resist fire and are often rated according to a national, or other officially recognised, standard for that purpose. In Australia fire doors are rated to Australian Standard AS 1905 and should carry a compliance tag to this effect. Fire doors often are associated with intumescent seals.

Figure 9:
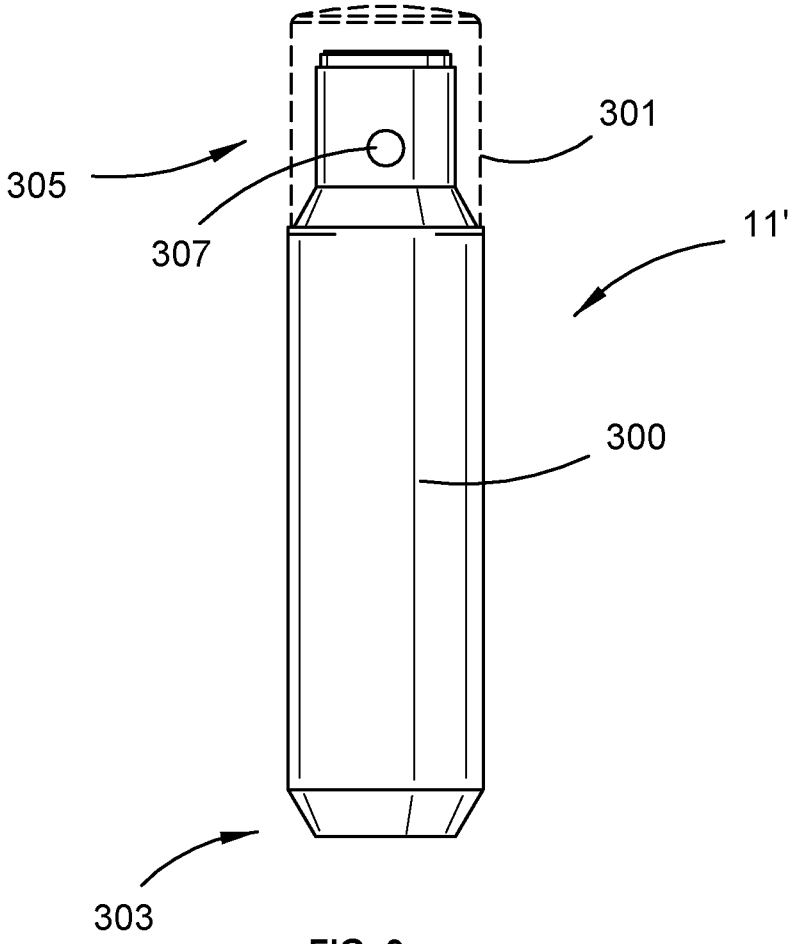
FIG. 9 is a side view of a pin.

FIG. 9 illustrates an alternate pin 11' including a rigid body 300 and a compliant top 301 (shown in dotted line). The body 300 is formed of high magnetic steel and nickel-plated per the pin 11. In this example, most of the body's exterior is cylindrical. Other shapes are possible, e.g. a square profile would be workable. A lower end 303 of the body is chamfered for ease of insertion into the sleeve 13. A top end of the body 300 includes a stepped down section 305 over which the compliant top 301 is moulded. The stepped down section 305 is bisected by a transverse through-hole 307 into which the over-moulded material of the top 301 is receivable to grip the body 303.

Gripping formations, such as undercuts, other than the hole 307 by which the top 301 may grip the body 300 are possible.

The top 301 is an over-moulded cap formed of silicon rubber which, in this example, has a Shore hardness of 90A. Other suitably compliant (i.e. non-rigid) materials are possible.

The cylindrical exterior of the body 300 is dimensioned to slide within the sleeve 13. Its nickel-plated finish minimises the friction at the relevant interfaces. The top 301 presents a smaller cylindrical exterior concentric to the body 300 whereby the top 301 is set back from the exterior of the body 300 so as to clear the sleeve 13, to ensure that the top 301 does not grip the sleeve 13.

The top 301 takes the form of an over-moulded cap whereas other variants are possible, e.g. a cap could be manually fitted or a simple disc of suitable compliant material could be simply adhered to a top end of a simple cylindrical variant of the rigid body 300.

The compliant top 301 acts as a shock absorber and a friction brake. When the pin 11' is upwardly drawn by the door-carriable portion 2, it is the top 301 which bears against the striker plate 7. The noise and harsh feeling associated with metal to metal contact is thereby avoided. Indeed, preferred forms of the door stop incorporating the pin 11' are almost silent.

Engaging members other than pins, such as flaps, may also benefit from the addition of a compliant contacting portion. It is also contemplated that the striker plate might be fitted with a suitably compliant portion for contacting the engaging member.

The invention claimed is:

1. A door-carriable portion, for a door stop, to be carried by a door;

the door-carriable portion being magnetically co-operable with a floor-carriable portion to lift an engaging member of the floor-carriable portion in an upward, lifting direction as the door is moved in a swinging direction;

the door-carriable portion including an inclined portion configured to bear against and, as a result of the inclined nature of the inclined portion, downwardly move the engaging member in a downward direction opposite to the upward, lifting direction as the door is moved in the swinging direction to bring the door to a soft stop; and a stop portion positioned relative to the inclined portion such that when the door is moved in the swinging direction, the stop portion follows the inclined portion, the stop portion being shaped to be blocked by the engaging member to stop the door when the door is slammed in the swinging direction.

2. The door-carriable portion of claim 1 including a member defining the inclined portion and the stop portion.

3. The door-carriable portion of claim 1 wherein the inclined portion is curved so as to vary a speed at which the engaging member is moved in the downward direction relative to a speed of the door in the swinging direction.

4. The door-carriable portion of claim 1 wherein the inclined portion is a rear of a recess for receiving an end of the engaging member.

5. The door-carriable portion of claim 1 wherein the inclined portion is a rear of an at least approximately spherical recess for receiving an end of the engaging member.

6. The door-carriable portion of claim 1 including a magnet receivable within a drilled cylindrical hole opening from a bottom of the door; and a striker plate having screw holes by which it is fastenable to the bottom of the door to at least partly span the opening to retain the magnet.

7. A door stop including a floor-carriable portion; and a door-carriable portion magnetically co-operable with the floor-carriable portion to lift an engaging member of the floor-carriable portion in an upward, lifting direction as the door is moved in a swinging direction;

the door-carriable portion including an inclined portion configured to bear against and, as a result of the inclined nature of the inclined portion, downwardly move the engaging member in a downward direction opposite to the upward, lifting direction as the door is moved in the swinging direction to bring the door to a soft stop; and a stop portion positioned relative to the inclined portion such that when the door is moved in the swinging direction, the stop portion follows the inclined portion, the stop portion being shaped to be blocked by the engaging member to stop the door when the door is slammed in the swinging direction.

8. The stop of claim 7 wherein the floor-carriable portion includes a floor-contacting member having a body, for insertion into a hole in the floor, and a portion projecting outwardly from an end of the body to sit atop the floor.

9. The stop of claim 8 wherein the portion projecting outwardly from an end of the body is an annular flange.

10. The stop of claim 9 wherein the portion projecting outwardly from an end of the body has a top and an outer periphery, and the top slopes downwardly towards the outer periphery.

11. The stop of claim 8 wherein the floor-contacting member is dimensioned to project no more than 3 mm above the floor.

12. The stop of claim 7 wherein the engaging member includes a rigid body and a compliant top.

* * * * *